United States Patent [19]

Chu et al.

[11] 4,362,968

[45] Dec. 7, 1982

[54] SLOW-WAVE WIDEBAND CYCLOTRON AMPLIFIER

[75] Inventors: Kwo R. Chu, Annandale, Va.; Phillip A. Sprangle; Victor L. Granatstein, both of Silver Spring, Md.

[73] Assignee: The United States of America as represented by the Secretary of the Navy, Washington, D.C.

[21] Appl. No.: 162,702

[22] Filed: Jun. 24, 1980

[51] Int. Cl.[3] ..... H01J 25/34

[52] U.S. Cl. ..... 315/3.5; 315/4; 315/5; 315/3.6

[58] Field of Search ..... 315/3, 4, 5, 3.5, 3.6, 315/39.3

[56] References Cited

U.S. PATENT DOCUMENTS

| | | | |
|---|---|---|---|
| 2,654,047 | 9/1953 | Clavier | 315/5 X |
| 2,661,441 | 12/1953 | Mueller | 315/5 X |
| 2,869,023 | 1/1959 | Brewer | 315/3.6 |
| 2,999,959 | 9/1961 | Kluver | 315/3.6 |
| 3,072,817 | 1/1963 | Gordon | 315/3 |
| 3,184,632 | 5/1965 | Weibel | 315/4 |
| 3,270,241 | 8/1966 | Vural | 315/3 |
| 3,348,093 | 10/1967 | Holly | 315/4 X |
| 3,789,257 | 1/1974 | Friedman et al. | 315/5 |
| 4,122,372 | 10/1978 | Walsh | 315/5 |
| 4,199,709 | 7/1980 | Alirot et al. | 315/4 |
| 4,224,576 | 9/1980 | Granatstein et al. | 315/5 |
| 4,225,806 | 9/1980 | Le'Gardeur | 315/4 |
| 4,298,824 | 11/1981 | Walsh | 315/4 |
| 4,306,174 | 12/1981 | Mourier | 315/4 |

*Primary Examiner*—Saxfield Chatmon, Jr.

*Attorney, Agent, or Firm*—Robert F. Beers; William T. Ellis; Charles E. Krueger

[57] ABSTRACT

A slow-wave, cyclotron-type, travelling-wave-tube amplifier in which the beam-wave interaction is the result of a Weibel-type instability. The travelling wave is slowed down in its propagation through the waveguide by a dielectric liner located on the inner wall of the waveguide. The bunching mechanism is the result of the $V_{\perp} \times B_{\perp}$ Lorentz force.

8 Claims, 5 Drawing Figures

SLOW-WAVE WIDEBAND CYCLOTRON AMPLIFIER

BACKGROUND OF THE INVENTION

This invention relates to travelling wave amplifiers and especially to a travelling-wave-tube amplifier of the cyclotron type which has wideband characteristics.

The ability of travelling wave and cyclotron-type tubes to amplify electromagnetic wave signals of high frequency is well known. However, to obtain wideband amplification in such devices, it has been necessary to employ complex and expensive periodic structures. The frequency of such devices is limited by the dimensions of such structures.

SUMMARY OF THE INVENTION

An object of the present invention is to increase the bandwidth of travelling wave tubes without employing complex and expensive structures.

This and other objects of the present invention are accomplished by the use of a dielectric-lined waveguide in a travelling wave tube. The beam-wave interaction in the device is the result of the Weibel-type instability instead of the Cerenkov instability as in the case of the travelling wave tube (TWT) and the cyclotron maser instability as in the gyrotron travelling wave amplifier (gyro-TWA). More specifically, the bunching mechanism in the present invention is due to the $V_\perp \times B_\perp$ Lorentz force ($V_\perp$ and $B_\perp$ are the transverse electron velocity and RF magnetic field, respectively) rather than the $eE_z$ electric force as in the TWT or the $eE_\perp$ electric force as in the gyro-TWA. Furthermore, in contrast to the TWT, the free energy in the present device resides in the transverse gyrational motion of the electron instead of the axial streaming motion. In contrast to the gyro-TWA, where a fast-wave structure has to be employed, the present device requires a slow-wave structure. The dielectric in the waveguide acts to slow down the wave propagated through the waveguide.

BRIEF DESCRIPTION OF THE DRAWING

FIG. 1(*b*) is a graph showing the axial magnetic field intensity in the TWT;

FIG. 3(*b*) is a graph of gain vs. wavenumber for the invention.

DETAILED DESCRIPTION OF THE INVENTION

Figure 1A:
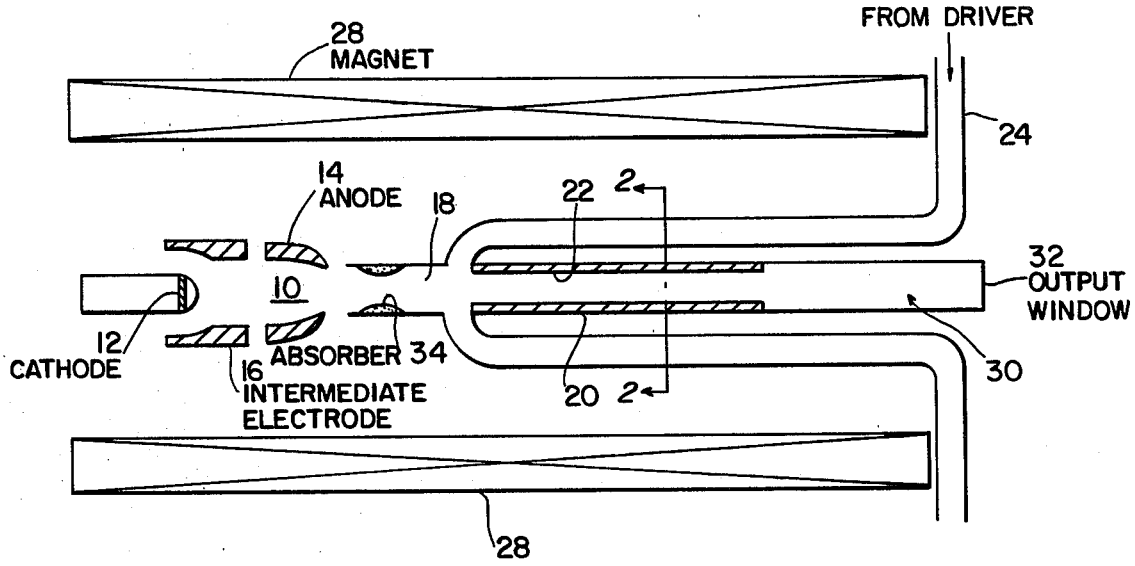
FIG. 1(*a*) is a schematic side view of an embodiment of a TWT employing the invention.
Figure 1B:
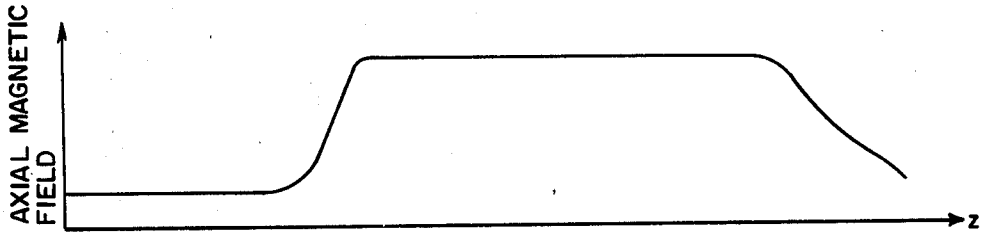
Figure 2:
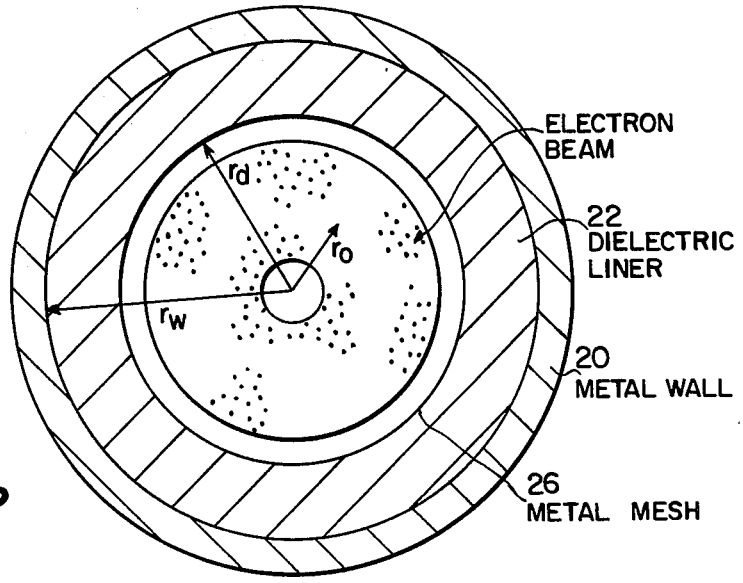
FIG. 2 is a cross-sectional view taken along the line 2—2 in FIG. 1(*a*)

FIG. 1(*a*) shows a side cross-section of an embodiment of the invention. A cyclotron-type travelling wave tube is shown comprising a magnetron-type electron injection gun 10 consisting of a cathode 12, an anode 14, and an intermediate electrode 16. An annular electron beam from the cathode 12 is propagated through the electrodes and a drift region 18 into a waveguide 20 the inner wall of which has a dielectric liner 22. The electromagnetic wave to be amplified is fed into the front end of the waveguide through another waveguide 24 fed by a driver.

To prevent static charge buildup, a metal mesh 26, or coating, may be attached to the inner surface of the dielectric liner 22. The entire system is placed inside a magnet 28 which generates a magnetic field the profile of which, relative to axial distance z along the tube, is shown in FIG. 1(*b*). Upon leaving the dielectric-liner waveguide, the electron beam is guided radially outward by the divergent magnetic field lines into the electron collector 30.

The dielectric material does not have to be in the form of a cylindrical liner on the inner wall of the TWT waveguide. It could be of any form and any location within the waveguide where it will interact with the propagating EM wave and slow it down. For example it could be in the form of a centrally located, longitudinal cylinder of dielectric.

The dielectric material should be one which has a low-loss tangent, such as alumina.

In operation, a driver wave is guided by the input waveguide 24 to the input ot the TWT waveguide 20 where it launches an EM wave in the interaction region (dielectric-lined region) where it is amplified by the electron beam. The amplified wave leaves through an output window 32, while any reflected wave is absorbed by a microwave absorber 34 located at the other end in front of the input to the TWT waveguide. The absorber 34 prevents spurious oscillations.

A typical slow-wave wideband cyclotron amplifier designed in accordance with the present invention employs the $TE_{01}$ waveguide mode and the fundamental beam cyclotron harmonic. It has the following design parameters:

| | |
|---|---|
| wave frequency | $f = 35$ GHz |
| beam voltage | $V_b = 71.5$ kV |
| beam current | $I_b = 9.2$ Amps |
| magnetic field | $B_o = 5.9$ kG |
| average beam radius | $r_o = 1.6$ mm |
| dielectric inner radius | $r_d = 3.2$ mm |
| dielectric material (alumina) | $\epsilon = 10$ |
| waveguide wall radius | $r_w = 4.6$ mm |
| power gain | $g = 2$ dB/cm |
| bandwidth | $\frac{\Delta\omega}{\omega} = 89.6\%$ (10 dB) |
| | 67.1% (20 dB) |
| | 53.7% (30 dB) |
| device efficiency | 10% |

Figure 3A:
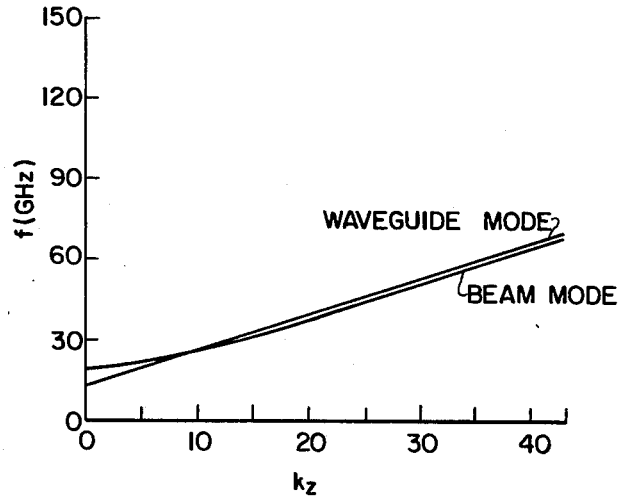
FIG. 3(*a*) is a graph of frequency vs. wavenumber for the invention.
Figure 3B:
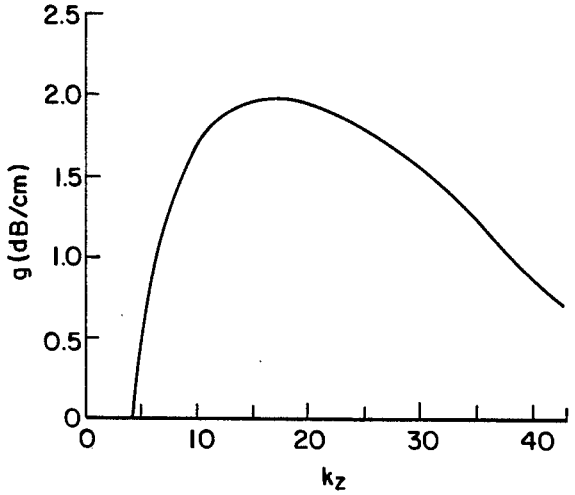

The dispersion curves (frequency f vs. wavenumber $k_z$) and the gain curve for the above design are shown in FIGS. 3(*a*) and 3(*b*), respectively. The dielectric-lined waveguide can propagate slow waves with a nearly constant group velocity over a wide frequency range, as is evident from FIG. 3(*a*), the waveguide mode curve. Thus, if the electron beam also propagates at the same velocity, it can interact with the wave over the constant-group-velocity frequency band. This is shown in FIG. 3(*b*) where the calculated gain, g, is plotted against the wave number $k_z$. It can be seen that a gain of over 1 db/cm is achieved over a frequency rannge of approximately 25–65 GHz.

Compared with the usual TWT amplifier, the present invention has a simple and inexpensive structure. It is expecially advantageous at millimeter wavelengths because the frequency is governed by the applied magnetic field rather than the dimensions of the structure. Compared with the gyrotron travelling wave amplifier, it has a much wider bandwidth (60% vs. 10%) and can use a magnetic field of lower intensity for a given frequency of operation.

Other slow-wave structures, such as the periodic waveguide, and a variety of wavelaunchers and beam collector geometries can be employed in conjunction with the dielectric liner. The present invention can also operate at cyclotron harmonic frequencies and with other waveguide modes (such as a TM mode, a higher-order TE mode, or a hybrid TE and TM mode).

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A gyrotron travelling wave amplifier comprising:
wave-launching means for launching a wave;
beam producing means for forming an annular beam of electrons propagating along a path with velocity $V_z$;
a dielectric lined slow-wave structure for slowing the group velocity, $V_g$, of the wave so that $V_z \times V_g$ wherein $V_g$ is constant over a wide frequency range; said slow wave structure being coupled to said wave launching means and said beam producing means so that said wave and said beam co-propagate within said slow wave structure, and wherein said wave interacts with and is amplified by said electron beam; and
means for generating a magnetic field B, within said slow wave structure, for causing cyclotronic motion of the electrons in said beam wherein the magnitude, $B_o$, of said magnetic field is adjusted so that the interaction between said wave and said beam is due to electron bunching caused by the $V_\perp \times B_\perp$ Lorentz force, where $V_\perp$ is the traverse velocity of an electron in said electron beam and $B_\perp$ is the magnetic field of said wave.

2. The gyrotron travelling wave amplifier recited in claim 1 wherein said slow-wave structure comprises:
a first waveguide, with an input end and an output end, for guiding a wave therein; and
a dielectric liner disposed within said first waveguide for slowing the group velocity, $V_g$, of said wave.

3. The gyrotron travelling wave amplifier recited in claim 2 wherein:
said first waveguide is of radius $r_w$; and
said dielectric liner is disposed along the inner wall of said waveguide with inner radius $r_d$.

4. The gyrotron travelling wave amplifier recited in claim 3 wherein said beam producing means comprises:
a magnetron-type electron gun disposed so that the beam propagates through said first waveguide from the input end to the output end.

5. The gyrotron travelling wave amplifier recited in claim 4 wherein said wave launching means comprises:
a driver for generating a wave; and
a second waveguide for guiding the wave from said driver to said first waveguide, wherein said second wave guide is coupled to said first waveguide so that the wave is launched from the input end of said first waveguide.

6. The gyrotron travelling wave amplifier recited in claim 5 wherein said magnetron-type electron gun comprises:
a cathode for generating the electrons that form the beam;
an anode for accelerating said electrodes, wherein the potential difference between said anode and said cathode is $V_b$ and wherein the beam current produced is $I_b$; and an intermediate electrode for forming an annular electron beam of radius $r_o$.

7. The gyrotron travelling wave amplifier recited in claim 6 wherein said dielectric liner is fabricated of alumina.

8. A method of amplifying a wave in a gyrotron traveling wave amplifier dielectric lined waveguide comprising:
launching a wave, with magnetic field $B_\perp$ and group velocity $V_g$, into the waveguide;
injecting an annular electron beam into the waveguide wherein the beam velocity is $V_z$;
slowing the wave in the waveguide so that $V_g = V_z$;
generating a magnetic field, $B_o$, about said electron beam wherein the cyclotron frequency of the electrons in said electron beam is determined by $B_o$; and adjusting the amplitude of $B_o$ so that the wave is amplified by the beam due to bunching caused by the $V_\perp \times B_\perp$ Lorentz force where $V_\perp$ is the transverse velocity of the electrons in the beam.

* * * * *